US011485593B2

(12) United States Patent
Shin et al.

(10) Patent No.: US 11,485,593 B2
(45) Date of Patent: Nov. 1, 2022

(54) PICKUP ROLLER ROTATED BY DRIVING FORCE FOR MOVING KNOCK-UP PLATE

(71) Applicant: Hewlett-Packard Development Company, L.P., Spring, TX (US)

(72) Inventors: DaeLim Shin, Suwon (KR); Heonjoo Kim, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 101 days.

(21) Appl. No.: 17/050,973

(22) PCT Filed: Mar. 25, 2019

(86) PCT No.: PCT/US2019/023815

§ 371 (c)(1),
(2) Date: Oct. 27, 2020

(87) PCT Pub. No.: WO2020/023085

PCT Pub. Date: Jan. 30, 2020

(65) Prior Publication Data

US 2021/0122595 A1 Apr. 29, 2021

(30) Foreign Application Priority Data

Jul. 25, 2018 (KR) ..... 10-2018-0086750

(51) Int. Cl.

| | |
|---|---|
| ***B65H 3/06*** | (2006.01) |
| ***B65H 1/12*** | (2006.01) |
| ***B65H 3/34*** | (2006.01) |

(52) U.S. Cl.

CPC ..... *B65H 3/0669* (2013.01); *B65H 1/12* (2013.01); *B65H 3/0661* (2013.01); *B65H 3/0684* (2013.01); *B65H 3/34* (2013.01); *B65H 2403/421* (2013.01); *B65H 2403/53* (2013.01)

(58) Field of Classification Search

CPC ..... B65H 3/0669; B65H 1/12; B65H 3/0661; B65H 3/0684; B65H 3/34; B65H 2403/421; B65H 2403/53

See application file for complete search history.

(56) References Cited

U.S. PATENT DOCUMENTS

| | | | |
|---|---|---|---|
| 5,370,380 | A | 12/1994 | Suzuki |
| 6,146,036 | A | 11/2000 | Kim |
| 7,681,877 | B2 | 3/2010 | Won |
| 2005/0218584 | A1 | 10/2005 | Dan |
| 2006/0269349 | A1 | 11/2006 | Kawanishi |

(Continued)

FOREIGN PATENT DOCUMENTS

| | | |
|---|---|---|
| CN | 1251918 | 5/2000 |
| CN | 1411993 | 4/2003 |

(Continued)

*Primary Examiner* — Thomas A Morrison
(74) *Attorney, Agent, or Firm* — Brooks, Cameron & Huebsch, PLLC

(57) ABSTRACT

A feeding apparatus includes a knock-up plate to be rotatably installed on a main body of an image forming apparatus and install a paper, a knock-up spring to elastically apply pressure to the knock-up plate in a direction of a pickup roller, a cam to be fixed at one end of a knock-up shaft and downwardly apply pressure to the knock-up plate, and a driving force transfer member to transfer a rotating force of the knock-up shaft to the pickup roller.

13 Claims, 8 Drawing Sheets

(56) References Cited

U.S. PATENT DOCUMENTS

| | | | | |
|---|---|---|---|---|
| 2013/0168920 | A1* | 7/2013 | Shin | B65H 3/565 271/152 |
| 2016/0152426 | A1* | 6/2016 | Hosohara | B65H 3/0669 271/117 |
| 2017/0297839 | A1 | 10/2017 | Miki | |

FOREIGN PATENT DOCUMENTS

| | | | |
|---|---|---|---|
| CN | 1456443 | | 11/2003 |
| CN | 1847121 | | 10/2006 |
| CN | 102408019 | | 4/2012 |
| CN | 103183244 | | 7/2013 |
| CN | 103708252 | | 4/2014 |
| CN | 103823343 | | 5/2014 |
| CN | 105269986 | | 1/2016 |
| EP | 1024411 | | 8/2000 |
| JP | 1991026623 | | 2/1991 |
| KR | 1999-0051559 | A | 7/1999 |
| KR | 20040024262 | | 3/2004 |
| KR | 20060013895 | | 2/2006 |
| KR | 100561441 | B1 | 3/2006 |
| KR | 20130067667 | | 6/2013 |
| RU | 2157332 | C2 | 10/2000 |

* cited by examiner

【FIG. 1】
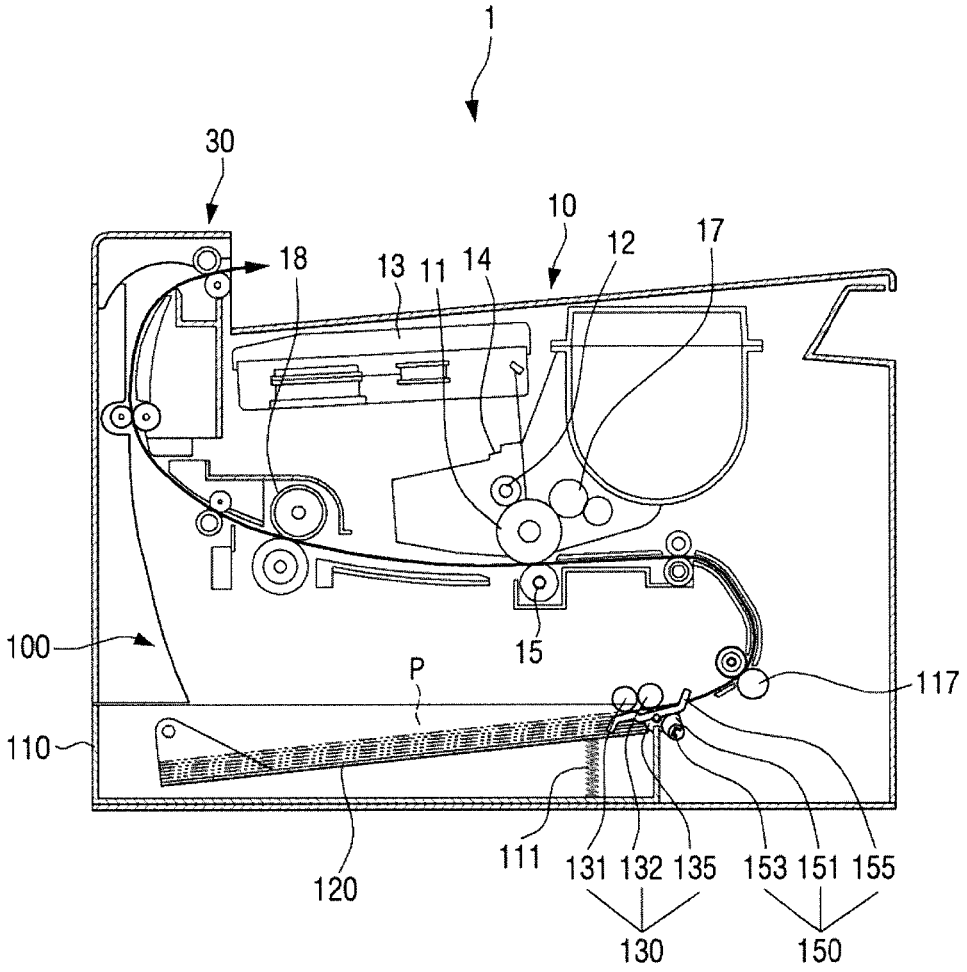

【FIG. 2】
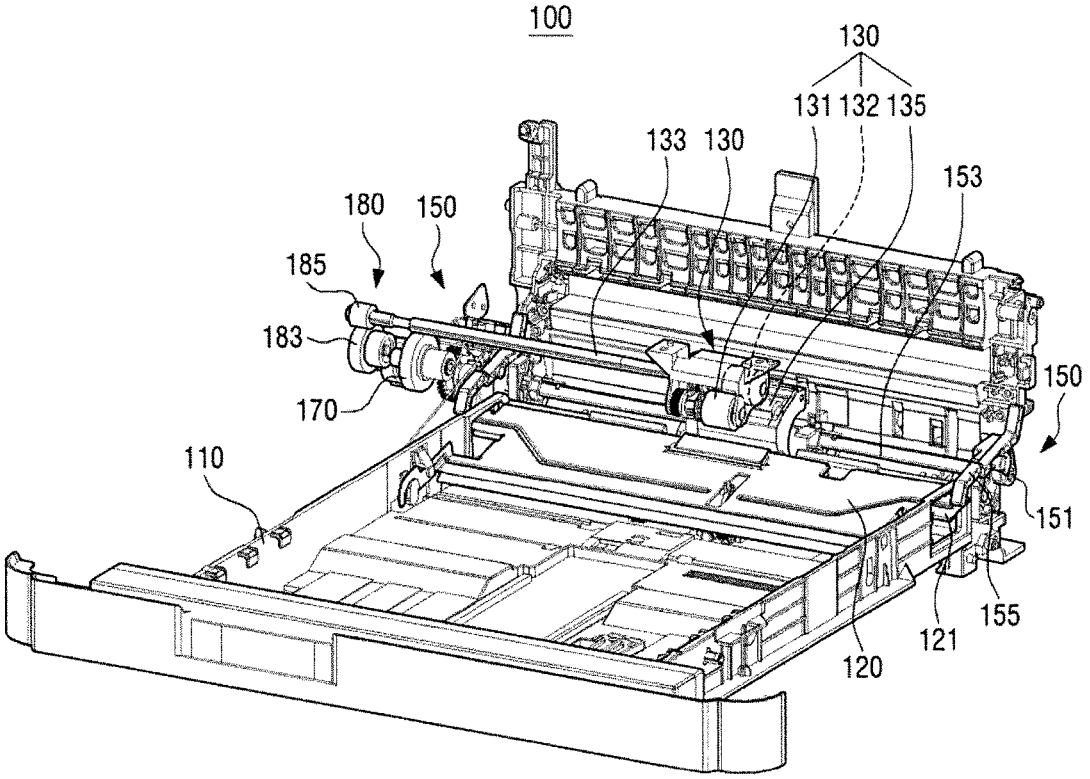

【FIG. 3】
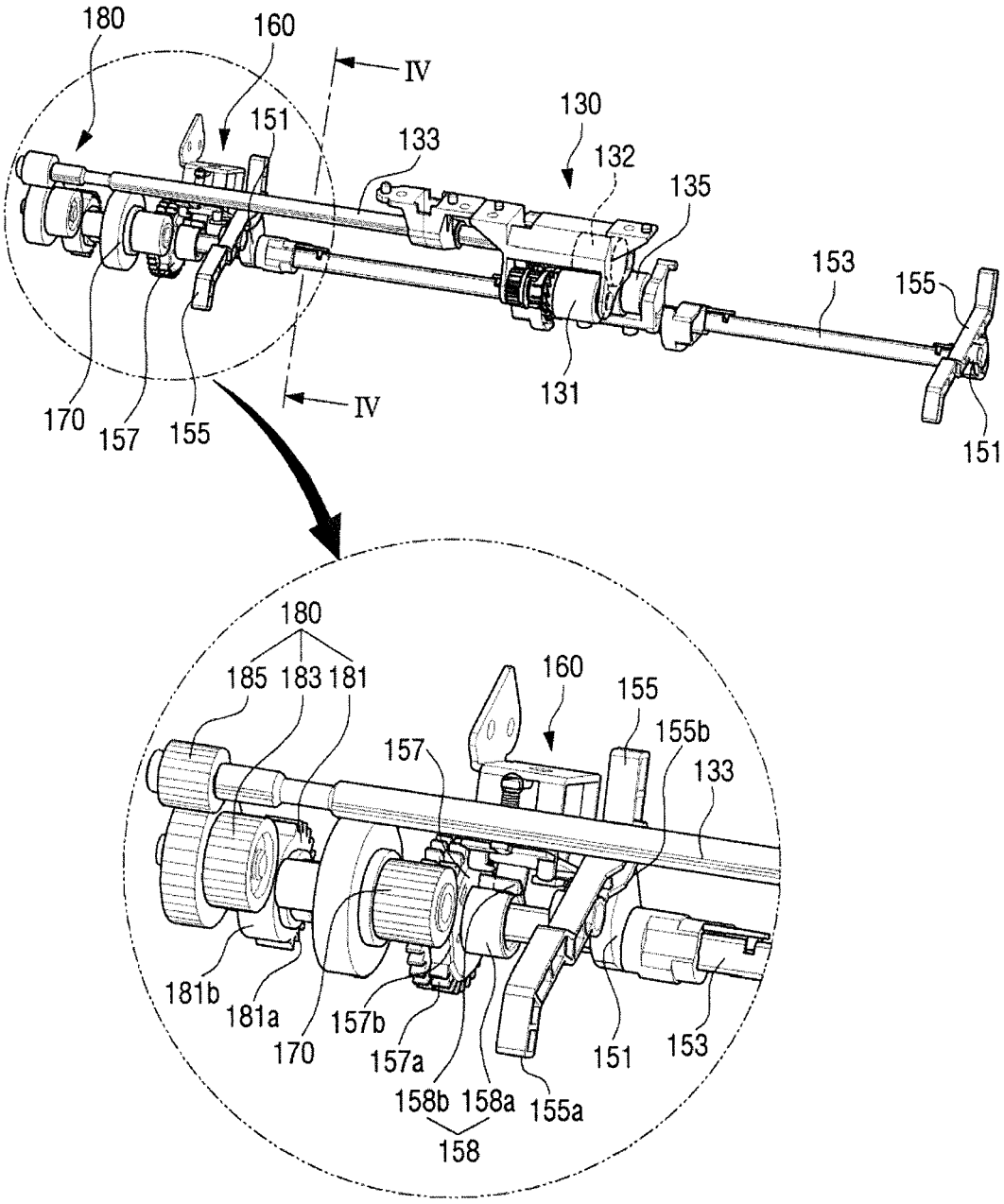

【FIG. 4】
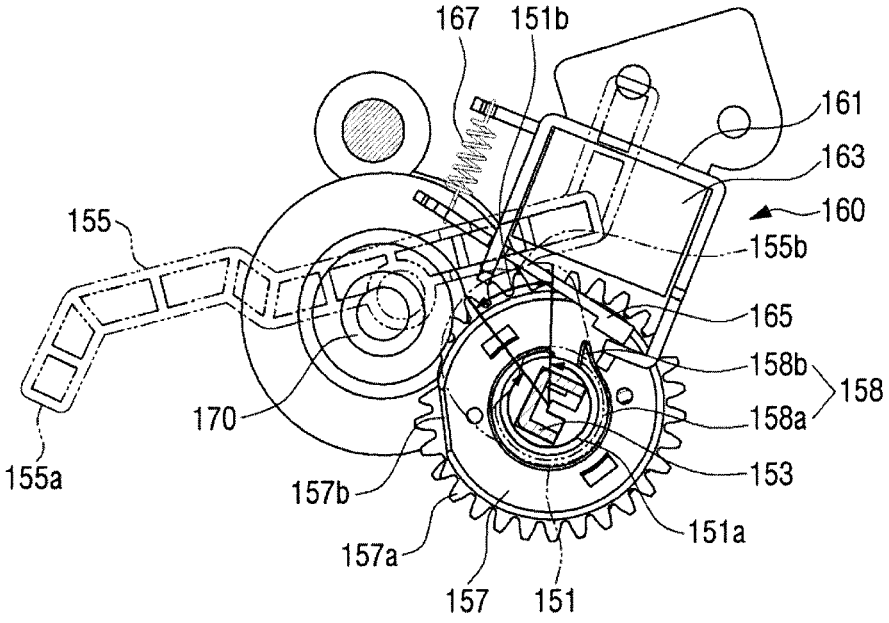

【FIG. 5A】
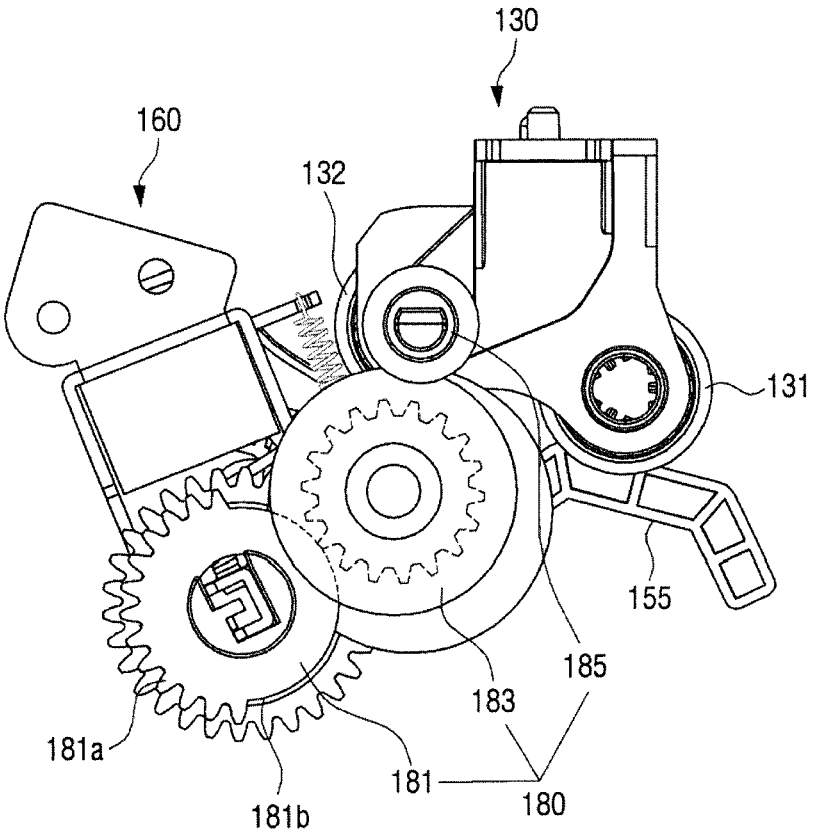

【FIG. 5B】
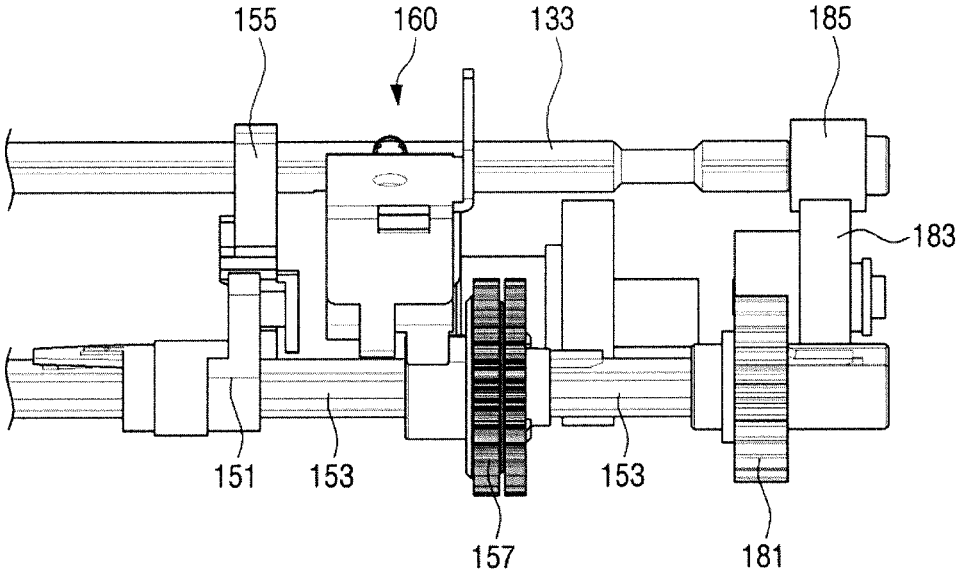

【FIG. 6】
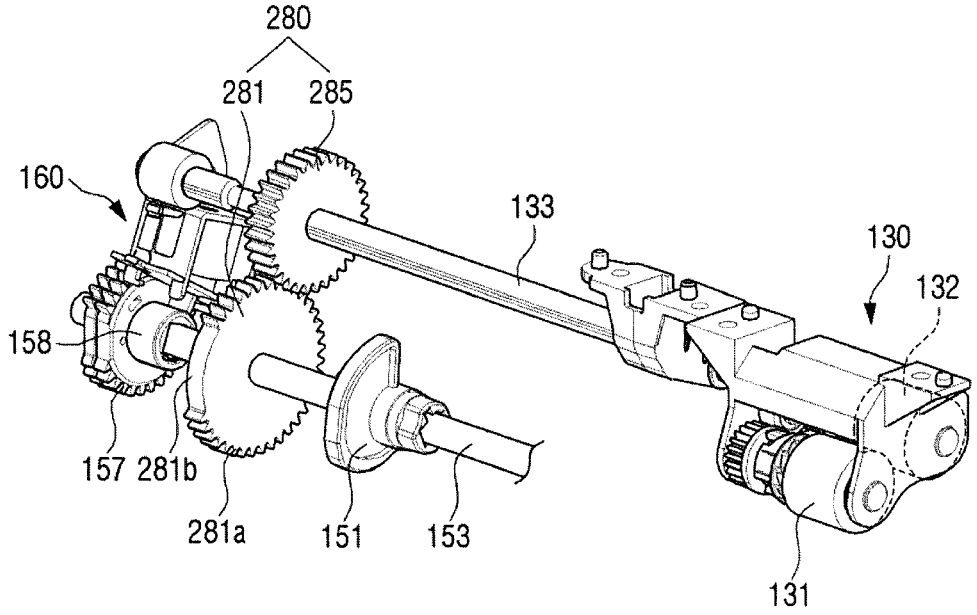

【FIG. 7A】
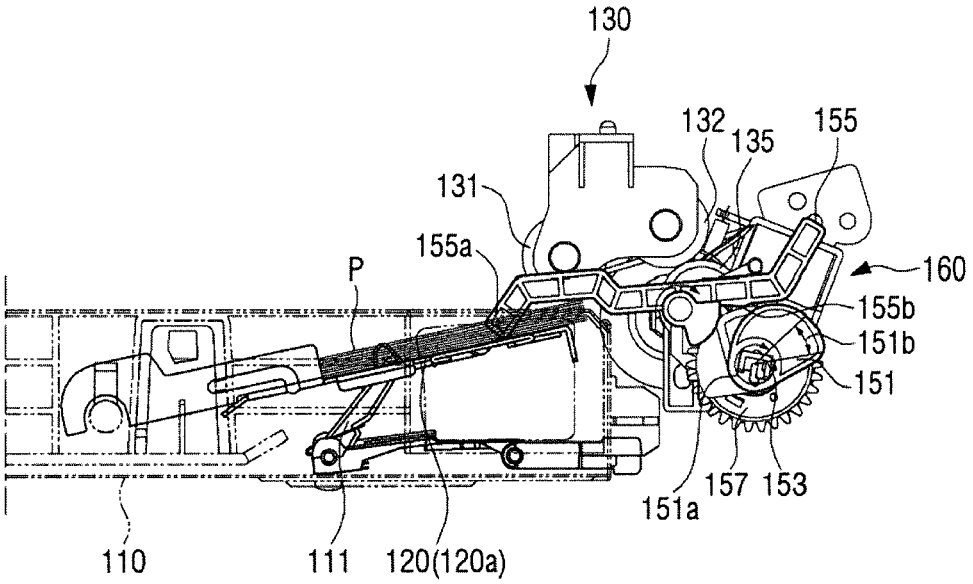
【FIG. 7B】
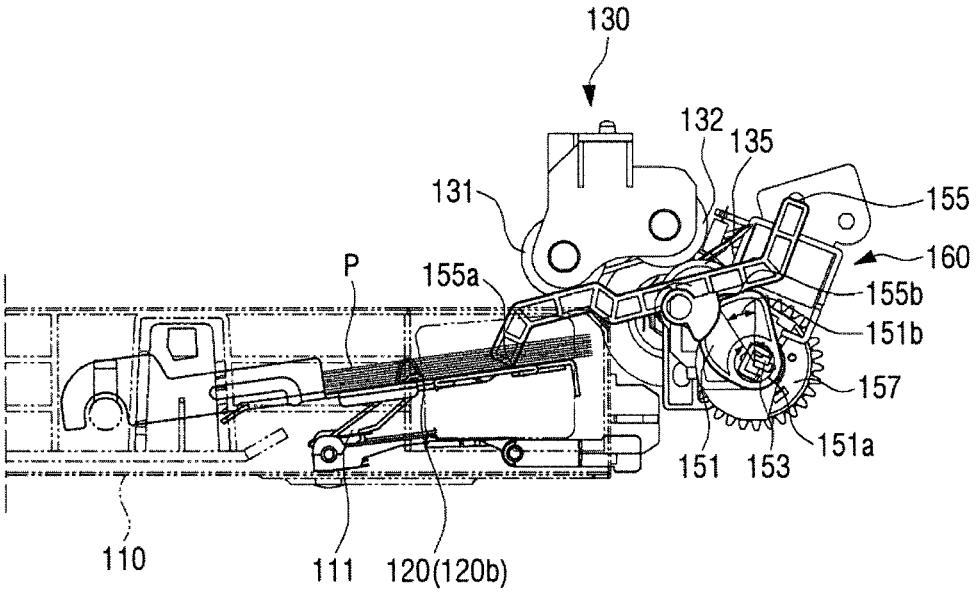

PICKUP ROLLER ROTATED BY DRIVING FORCE FOR MOVING KNOCK-UP PLATE

BACKGROUND

An image forming apparatus is an apparatus which performs generation, printing, reception, and transmission of image data, and examples thereof may include a printer, a copy machine, a facsimile, and a multifunction peripheral (MFP) in which functions of the above-described devices are combined.

The image forming apparatus includes a feeding apparatus having a paper stacked thereon and feeds papers to a print engine provided inside the image forming apparatus during a print job. The feeding apparatus picks up papers accepted in a cassette a piece at a time and transfers them to the print engine.

The feeding apparatus includes a knock-up plate on which a plurality of pieces of papers are stacked and a pickup roller picking up a piece from among the stacked papers. Once a print job is started, the pickup roller is rotated, and picks up and feeds an uppermost piece of paper from among the stacked papers. When the uppermost paper is picked up by the pickup roller and fed, a cam is rotated and applies a downward pressure to the knock-up plate, and thereby the knock-up plate is spaced apart from the pickup roller while feeding paper.

BRIEF DESCRIPTION OF THE DRAWINGS

FIG. 1 is a diagram illustrating an image forming apparatus, according to an example;

FIG. 2 is a perspective view of a feeding apparatus, according to an example;

FIG. 3 is a perspective view illustrating a portion of a feeding apparatus, according to an example;

FIG. 4 is a cross-sectional view taken along the line IV-IV illustrated in FIG. 3;

FIG. 5A is a rear view of the V illustrated in FIG. 3;

FIG. 5B is a side view of the V illustrated in FIG. 3;

FIG. 6 is a perspective view illustrating a power transmission apparatus, according to an example; and FIGS. 7A and 7B are diagrams illustrating an operation of a knock-up plate and a pickup member, according to an example.

DETAILED DESCRIPTION

The same reference numerals are used to represent the same elements throughout the drawings.

Examples will be described below with reference to the accompanying drawings. The drawings depict examples and therefore are not to be considered to be limiting of the scope of the disclosure. The examples described below may be modified and implemented in various different forms. In order to more clearly describe the features of the examples, a detailed description of known matters to those skilled in the art will be omitted.

Meanwhile, in the disclosure, a case in which any one feature is connected with the other feature includes a case in which the features are directly connected with each other and a case in which the parts are electrically connected with each other with other features interposed therebetween. Further, when a certain feature is stated as "comprising" a certain feature, unless otherwise stated, this means that the certain feature may include another feature, rather than foreclosing the same.

The term "image forming job" as used herein may mean various jobs related to the image (e.g., printing, scanning or faxing), such as forming an image or creating/storing/transmitting an image file. In addition, "job" may refer to an image forming operation as well as a series of processes necessary for performing an image forming operation.

An image forming apparatus generally operates to print out print data generated at a terminal such as a computer onto a printing paper. An example of an image forming apparatus includes a copier, a printer, a facsimile and a multi-function printer (MFP) that provides combined functionality of at least two of the single apparatuses. The image forming apparatus may refer to all apparatuses capable of performing an image forming operation, such as a printer, a scanner, a fax machine, an MFP, a display apparatus, or the like.

In addition, "hard copy" may refer to an operation of outputting an image on a printing medium such as paper, and the like, and "soft copy" may refer to an operation of outputting an image in a display apparatus, such as TV, monitor, and the like.

In addition, "content" may refer to all types of data that are subject to an image forming operation, such as a photo, image, document file, or the like.

In addition, "print data" may refer to data that is converted into a format printable in a printer. Meanwhile, if a printer supports direct printing, the file itself may be print data.

In addition, "user" may refer to a person who performs an operation related to an image forming operation using an image forming apparatus or a device connected to the image forming apparatus via wire or wirelessly. In addition, "manager" may refer to a person who has the authority to access all functions and the system of the image forming apparatus. The "manager" and the "user" may be the same person.

FIG. 1 is a diagram briefly illustrating an image forming apparatus, according to an example.

As illustrated in FIG. 1, an image forming apparatus 1 may include a feeding apparatus 100, a print engine 10, and a discharge apparatus 30.

The feeding apparatus 100 accepts a paper P, and feeds the paper P to the print engine 10. The discharge apparatus 30 may discharge the paper P passing through the print engine 10 outside. The feeding apparatus 100 will be described in detail later.

The print engine 10 may form an image on a paper P fed from the feeding apparatus 100. The print engine 10 may form an image on the paper P by an electrophotography method.

The print engine 10 may include a photosensitive drum 11, a charger 12, an exposure apparatus 13, a developer 14, a transferring apparatus 15, and a fixing apparatus 18. In FIG. 1, it is described that the print engine 10 and the feeding apparatus 100 are different elements, but the feeding apparatus 100 may be an element in the print engine 10.

An electrostatic latent image is formed in the photosensitive drum 11. For example, an image may be formed on the photosensitive drum 11 by an operation of the charger 12 and the exposure device 13 which will be described later. The photosensitive drum 11 may be referred to as an image forming medium, a photosensitive drum, a photosensitive belt, and the like, according to forms.

Hereinafter, for the convenience of explanation, the feature of the print engine 10 corresponding to one color will be described as an example, but at the time of implementation, the print engine 10 may include a plurality of photosensitive drums 11 corresponding to a plurality of colors, a plurality of chargers 12, a plurality of exposure devices 13, a plurality of developers 14, an intermediate transfer belt (not illustrated).

The charger 12 charges the surface of the photosensitive drum 11 to a uniform potential. The charger 12 may be implemented as a corona charger, a charging roller, a charging brush, and the like.

The exposure apparatus 13 may change the surface potential of the photosensitive drum 11 based on information on an image to be printed to form an electrostatic latent image on the surface of the photosensitive drum 11. As an example, the exposure device 13 may electrostatic latent image by irradiating the photosensitive drum 11 with light modulated in accordance with the information on the image to be printed. An exposure device 13 of this type may be referred to as a light scanning device or the like, and an LED may be used as a light source.

The developer 14 accommodates a developing agent therein, and develops the electrostatic latent image into a visible image through supply of the developing agent (e.g., a toner) onto the electrostatic latent image. The developer 14 may include a developing roller 17 for supplying the developing agent to the electrostatic latent image. For example, the developer may be supplied from the developing roller 17 to the electrostatic latent image which is formed on the photosensitive drum 11 by the developing electric field formed between the developing roller 17 and the photosensitive drum 11.

The visible image which is formed on the photosensitive drum 11 is irradiated to a printing paper by the transferring device 15 or an intermediate transfer belt (not illustrated). The transfer device 15 may transfer the visible image to a printing paper, for example, by the electrostatic transfer method. The visible image is attached to the printing paper by electrostatic attraction.

The fixing apparatus 18 fixes a visible image on the printing paper by applying heat or pressure to a visible image on the printing paper. The printing operation is completed by this series of processes.

The feeding apparatus 100 may include a paper cassette 110, a knock-up plate 120 having a paper P stacked thereon and rotatably installed in a up-and-down direction on the paper cassette 110, a moving member 150 receiving driving force from a driving source (not illustrated) installed inside a body and moving the knock-up plate 120 up and down, and a pickup member 130 receiving a driving force from the moving member 150 and picking up a paper stacked on the knock-up plate 120.

One side of the knock-up plate 120 may be hinge-coupled to the paper cassette 110 and thereby, the other side may be rotated at a predetermined angle and move up or down.

The knock-up plate 120 may be elastically pressurized in a direction of the pickup roller 131 so that the stacked paper P comes in contact with the pickup roller 131. A knock-up spring 111 may be connected to the knock-up plate 120 to be pressurized in the direction of the pickup roller 131.

A driving source installed inside the body may be a driving motor driving the moving member 150. That is, an additional driving source for driving the pickup member 130 may not be provided in the feeding apparatus 100 according to an example.

The moving member 150 may include a knock-up shaft 153 (see FIG. 2), a cam 151 coupled to the knock-up shaft 153 and is rotated together with the knock-up shaft 153, and a knock-up lever 155 being rotated by rotation of the cam 151 and applying pressure to the knock-up shaft 153.

The pickup member 130 may be configured to include a pickup roller 131, a feeding roller 132 feeding a paper P picked up by the pickup roller 131 into the main body, and a retard roller 135 for preventing double feeding of a paper P picked up by the pickup roller 131.

The pickup roller 131 comes into contact with the paper P and picks up the paper P. The pickup roller 131 is installed on an upper side of the paper cassette 110, and picks up the stacked papers P a piece at a time and transfers it to toward the transfer roller 117.

The pickup roller 131 may be rotated to pick up the paper P stacked on the paper cassette 110, and may be stopped when a front end of the paper P reaches the transfer roller 117.

The pickup roller 131 may, when performing a feeding job, be rotated by indirectly receiving a driving force of a driving source (not illustrated) from the moving member 150 via a driving force transfer member 180 (see FIG. 2) which will be described later. After the paper P is picked up, a driving force is blocked and the pickup roller 131 may be stopped or idly rotated.

The feeding roller 132 may move the paper P picked up by the pickup roller 131 on the knock-up plate 120 toward the transfer roller 117.

The retard roller 135 facing the feeding roller 132 is provided to prevent double feeding of the paper P fed from the paper cassette 110. The retard roller 135 may be rotatable in a forward or reverse direction. In a state in which the feeding roller 132 is pressed and at least two pieces of paper is transferred, the retard roller 135 may separate the papers and transfer one piece of paper P to the print engine 10.

The pickup roller 130 in a retard method may form a size of each of the pickup roller 131, the feeding roller 132 and the retard roller 135 to be small to minimize space occupied in the feeding apparatus 100. Accordingly, it is necessary to drive the pickup roller 131 to rotate multiple times to pick up a piece of paper.

Accordingly, the feeding apparatus 100 according to an example may include a driving force transfer member 180 connecting the moving member 150 with the pickup member 130 and thus, it is possible to raise and drop the knock-up plate and rotate the pickup roller 131 by a single driving force even in a case where the pickup roller 131 rotates multiple times. The driving force transfer member 180 will be described later.

The transfer roller 117 may be formed as a pair of rollers facing each other and rotated, and move a paper P fed by the feeding roller 132 to the print engine 10.

FIG. 2 is a perspective view of a feeding apparatus according to an example. FIG. 3 is a perspective view illustrating a portion of a feeding apparatus according to an example.

Referring to FIGS. 2 and 3, a feeding apparatus according to an example may include a knock-up plate 120 rotatably installed in a paper cassette 110 of an image forming apparatus and having a paper stacked thereon, a pickup roller 131 installed in a main body and picking up a paper stacked on the knock-up plate 120, and a cam 151 spacing the knock-up plate 10 apart from the pickup roller 131 when the paper P is picked up and fed.

The feeding apparatus 100 may include a driving force transfer member 180 transferring a rotating force of the cam 151 to the pickup roller 131. The driving force transfer member 180 may be configured such that a driving force of a driving source is transferred to or blocked from the pickup roller 131 in conjunction with a position of the knock-up plate 120 without using an electronic control element.

The pickup roller 131 may be rotated in conjunction with the cam 151. For example, when the knock-up plate 120 is raised by the cam 151, the pickup roller 131 may rotate to pick up a paper, and when a paper is picked up, the cam 151 may apply pressure to the knock-up plate 120 to be spaced apart from the pickup roller 131 and the pickup roller 131 may be stopped. The driving force transfer member 180 will be described in detail later.

The paper cassette 110 may have a rectangular plate of which an upper surface is opened so that a paper may be stacked thereon. The paper cassette 110 may be disposed to be detachable from a main body so that a user may feed and load a paper.

The knock-up plate 120 may be installed on an opened bottom surface of the paper cassette 110 so that a paper is loaded onto the plate. One end of the knock-up plate 120 may be rotatably installed on the paper cassette 110. An elastic member 111 (see FIG. 1) may be disposed between a rear surface of the knock-up plate 120 and the paper cassette 110. The knock-up spring 111 may apply pressure to the knock-up plate 120 in an upward direction so that a front end of the knock-up plate 120 faces toward the pickup roller 131.

The knock-up spring 111 may be, as a non-limiting example, a compression coil spring, but is not limited thereto. Various members capable of applying pressure to the paper cassette 110 toward the pickup roller 131 may be applied.

The knock-up plate 120 may be pressed toward the pickup roller 130 by the knock-up spring 111, and may be disposed such that an uppermost paper P from among papers stacked on the plate may be picked up by the pickup roller 131. A state in which the knock-up plate 120 is at this position is referred to as a knock-up state.

In the knock-up state, the knock-up plate 120 may be disposed such that an uppermost paper from among the stacked papers P is in contact with the pickup roller 131.

The feeding apparatus 100 may include a moving member 150 for spacing the knock-up plate 120 upwardly pressed by the knock-up spring 111 from the pickup roller 131.

The moving member 150 may include a knock-up shaft 153 rotatably installed on a main body, a cam 151 coupled to one end of the knock-up shaft 153, and a knock-up lever 155 rotating to apply pressure to the knock-up plate 120 by rotation of the cam 151.

When a paper P is picked up and fed, the moving member 150 may apply pressure to the knock-up plate 120 so that the knock-up plate 120 is spaced apart from the pickup roller 131.

The moving member 150 may be disposed at one end of the knock-up plate 120. The moving member 150 may be disposed to be symmetrical to the opposite ends of a width direction of the knock-up plate 120 for stable movement of the knock-up plate 120.

The knock-up shaft 153 may be rotatably installed on an upper part of the knock-up plate 120. The knock-up shaft 153 may receive a driving force from a driving source (not illustrated) and may be rotated in a predetermined direction.

A pair of cams 151 and a knock-up lever 155 may be installed at the opposite ends of the knock-up shaft 153, respectively.

The cam 151 may be fixedly installed on the knock-up shaft 153, and the installed cam 151 may be rotated together with the knock-up shaft 153 according to rotation of the knock-up shaft 153. The cam 151 may include a cam trajectory which is installed to be in contact with one end of the knock-up lever 155 and rotates the knock-up lever 155 back and forth within a predetermined range according to rotation of the cam 151. The knock-up lever 155 may be installed to directly pressurize the knock-up plate 120. The knock-up lever 155 is in contact with a contact part 121 of the knock-up plate 120. The contact part 121 is disposed to protrude from the opposite ends of a front end part of the knock-up plate 120. The knock-up lever 155 may be in contact with an upper part of the contact part 121. When the knock-up lever 155 is dropped, the knock-up plate 120 may be pushed down by the knock-up lever 155 and disposed at a release position (120*b* of FIG. 7B).

The cam 151 rotates the knock-up lever 155 and the knock-up lever 155 applies pressure to the knock-up plate 120, and thereby the cam 151 indirectly applies pressure to the knock-up plate 120. In FIG. 3, it is described that the cam 151 indirectly pressurizes the knock-up plate 120, but the example is not limited thereto, and it may be configured such that the cam 151 directly applies pressure to the knock-up plate 120 in a downward direction.

The driving force transfer member 180 connected to the knock-up shaft 153 may transfer a rotating force of the knock-up shaft 153 to the pickup member 130. By the driving force transfer member 180, the pickup member 130 may be rotated multiple times with a rotating force of a single rotation of the knock-up shaft 153.

The pickup member 130 may be configured to include a pickup roller 131, a feeding roller 132 feeding a paper P picked up by the pickup roller 131 into the main body, and a retard roller 135 for preventing double feeding of a paper P picked up by the pickup roller 131.

The feeding roller 132 may be coupled to the pickup shaft 133 installed in the main body. The feeding roller 132 may be disposed adjacently to the pickup roller 131 to transfer a picked-up paper, and may be rotated together with the pickup shaft 133 by rotation of the pickup shaft 133.

The pickup shaft 133 may be rotated by a rotating force of the knock-up shaft 153 received through the driving force transfer member 180. The pickup shaft 133 may be rotated in conjunction with the cam 151 of the moving member 150.

A pickup gear 185 of the driving force transfer member 180 transferring a rotating power of the knock-up shaft 153 may be connected to an end part of the pickup shaft 133.

The pickup roller 131 may be spaced apart from the feeding roller 132 by a predetermined distance and disposed in parallel with the feeding roller 132.

The pickup roller 131 may be installed on an upper side of a front end of the knock-up plate 120. When the knock-up plate 120 is in a knock-up state, the pickup roller 131 may pick up and transfer an uppermost paper from among the papers stacked on the knock-up plate 120.

A cross-section of the pickup roller 131 may be cylindrical. Due to the cylindrical shape of the pickup roller 131, a pickup speed of the pickup roller 131 may be increased. The pickup roller 131 of a cylindrical shape may adjust a pickup period of a paper P by using the driving force transfer member 180 which will be described later. For example, a pickup period may be adjusted by a tooth form area 181*a* formed in a part of a circumference of a transfer gear 181 and a cutting area 181*b* formed in the remaining area.

In addition, the pickup roller 131 may be installed to rotate by a rotating force transferred to the feeding roller 132 through the pickup shaft 133.

To this end, a coupling part (not illustrated) transferring a rotating force transferred to the feeding roller 132 to the pickup roller 131 through the pickup shaft 133 may be provided in the pickup member 130. The coupling part may include a gear.

When the pickup shaft 133 is rotated, the feeding roller 132 and the pickup roller 131 may be rotated together by the coupling part (not illustrated). The pickup shaft 133 may be rotated in conjunction with the cam 151 of the moving member 150. That is, the pickup roller 131 may be rotated in conjunction with the cam 151.

To pick up a paper, the knock-up plate 120 may be raised and disposed at a pickup position at which the paper P may be picked up by the pickup roller 131, and the pickup roller 131 may be rotated. By the raised knock-up plate 120, the pickup roller 131 may be in contact with the paper and rotated and accordingly, the paper is picked up by a frictional force between the pickup roller 131 and the paper.

When a piece of paper is picked up, the knock-up plate 120 may be dropped by the moving member 150 by a paper interval and the pickup roller 131 may be spaced apart from the paper, and the pickup member 130 may be stopped.

FIG. 4 is a cross-sectional view taken along the line IV-IV illustrated in FIG. 3.

Referring to FIG. 4, a knock-up lever 155 may be rotatably connected to a separate rotation axis from a cam 151. The knock-up lever 155 may include a pressure part 155*a* which is a partial area in contact with a contact part 121 of a knock-up plate 120 and an uneven part 155*b* which is another partial area in contact with the cam 151.

The cam 151 of the moving member 150 may allow the knock-up plate 120 to move to the pickup position 120*a* (see FIG. 7A) by rotating the knock-up lever 155 according to a rotation phase thereof, or may move the knock-up plate 120 to a release position 120*b* (see FIG. 7B).

To this end, a cam trajectory of the cam 151 may include a pickup interval 151*a* allowing the knock-up plate 120 to move to the pickup position 120*a* and a release interval 151*b* moving the knock-up plate 120 to the release position 120*b*.

The knock-up lever 155 may be rotated clockwise or counterclockwise by the cam 151. The knock-up lever 155 may include a torsion spring (not illustrated). For example, the knock-up lever 155 may be elastically supported clockwise by the torsion spring, rotated counterclockwise when the uneven part 155*b* is pressed by rotation of the cam 151, and rotated clockwise when a force exerted to the uneven part 155*b* is released by rotation of the cam 151.

The feeding apparatus 100 may include a driving source for rotating the cam 151 so that the knock-up plate 120 is spaced apart. A solenoid 160 may be disposed at the knock-up shaft 153 in which the cam 151 is installed.

A drive gear 157 may be installed on one side of the knock-up shaft 153. The drive gear 157 may be engaged with an input gear 170, and the input gear 170 may be connected to a driving source (not illustrated), such as a driving motor, via a power train, such as a gear train and the like.

The drive gear 157 may include a tooth form area 157*a* and a cutting area 157*b*. The tooth form area 157*a* may be engaged with the input gear 170, and the cutting area 157*b* may, in a case in which the knock-up plate 120 is positioned at a release position, release the engagement of the input gear 170 and the drive gear 157.

A stopper 158 interacting with the solenoid 160 may be provided in the drive gear 157.

The stopper 158 may include a coupling part 158*a* surrounding the knock-up shaft 153 and a projection 158*b* formed at an end of the coupling part 158*a*. The coupling part 158*a* may be inclinably formed according to a circumferential direction of a coupling rib, and the projection 158*b* may be formed to protrude from an end of the coupling part 158*b* toward a circumferential surface of the coupling rib. The projection 158*b* may be formed in a normal direction of the coupling part 158*a*.

The solenoid 160 may include a bracket 161 forming an exterior, an actuator 163 supported by the bracket 161, and a moving plate 165 driven by the actuator, moved to the side of the projection 158*b* of the stopper 158 and restricting rotation of the drive gear 157.

The moving plate 165 is hinge-coupled to the bracket 161. A spring 167 elastically supporting the moving plate 165 to form a moving trajectory to a side of the stopper 158 may be provided at one end of the moving plate 165.

When the input gear 170 is rotated by a print signal, a drive gear 157 engaged with the input gear 170 at the tooth form area 157*a* is rotated. When the drive gear 157 is rotated, a cam 151 axially connected to the drive gear 157 is rotated, and by the rotation of the cam 151, the knock-up lever 155 may be rotated in a direction which does not apply pressure to the knock-up plate 1230 so that a force exerted to the knock-up plate 120 is released.

The knock-up plate 120 may be elevated to an upward direction by rotation of the knock-up lever 155. The pickup roller 131 receiving a rotating force of the knock-up shaft 153 by the driving force transfer member 180 may be rotated and pick up a paper stacked on the knock-up plate 120.

The projection 158*b* of the stopper 158 provided on one side of the drive gear 157 may be in a state of being spaced apart from the moving plate 165 by the actuator 163, and thus may be in a state in which a rotation of the drive gear 157 is not restrained.

Meanwhile, as described above, while the drive gear 157 is rotated, when the projection 168*b* of the stopper 158 is rotated once and returns to its initial position, a current applied to the actuator 163 may be blocked and the moving plate 165 may move to the projection 158*b* side by the spring 167 provided in the solenoid 160 and restrain rotation of the drive gear 157.

When a paper pickup signal is applied to the solenoid, the moving plate 165 of the solenoid 160 may move to an opposite direction of the projection 158*b* of the stopper 158 disposed on one side of the drive gear 157 so that the restraint of the drive gear 157 is released. Accordingly, the drive gear 157 may be rotated.

While the tooth form area 157*a* of the drive gear 157 is engaged with the input gear 170, when the drive gear 157 is rotated in a predetermined direction, the cam 151 may be rotated together with the drive gear 157. The cam 151 may be rotated and be in contact with the uneven part 155*b* of the knock-up lever 155. As the cam 151 is rotated, the knock-up lever 155 may be rotated to a release position by a cam trajectory and apply pressure to the knock-up plate 120 in a downward direction. When the cam 151 is continuously rotated while the knock-up lever 155 is in contact with the knock-up plate 120, the knock-up lever 155 may be rotated to a pickup position again, and the knock-up plate 120 may be rotated in an upward direction by the knock-up spring 111.

While the cutting area 157*a* of the drive gear 157 is engaged with the input gear 170, the drive gear 157 may be stopped and the cam 151 may be stopped together with the drive gear 157 so that the knock-up plate 120 may be positioned as being spaced apart from the pickup roller 131.

When the drive gear 157 is rotated, the cam 151 may be moved to a knock-up position. The pickup roller 131 receiving a rotating force of the knock-up shaft 153 via the driving force transfer member 180 may be rotated and pick up an uppermost piece of paper from among papers stacked on the knock-up plate 120.

The drive gear 157 is rotated once by the solenoid 160. Thereby, the knock-up shaft 153 is rotated once so that the knock-up plate 120 moves to a distanced position from a knock-up position.

The pickup roller 131 may be rotated more than one rotation by a one-rotation rotating force of the knock-up shaft 153 received through the driving force transfer member 180 which will be described later. The driving force transfer member 180 may be configured to drive the pickup roller 131 in multiple rotations.

FIG. 5A is a rear view of V illustrated in FIG. 3. FIG. 5B is a side view of V illustrated in FIG. 3. FIGS. 5A and 5B are diagrams illustrating a driving force transfer member, according to an example.

Referring to FIGS. 5A and 5B, the driving force transfer member 180 may include a transfer gear 181, an intermediate gear 183, and a pickup gear 185.

The pickup gear 160 may be disposed on the pickup shaft 133 rotatably supporting the pickup roller 131.

A drive gear 157 connected to a driving source (not illustrated) may be provided on one side of the knock-up shaft 153. The drive gear 157 may receive a driving force from the driving source and be rotated, and the knock-up shaft 153 may be rotated together with the drive gear 157 coupled thereto.

A transfer gear 181 may be provided in the knock-up shaft 153. The transfer gear 181 may be disposed at a rear end of the drive gear 157. In FIG. 3, it is described that the transfer gear 181 is disposed at a rear end of the drive gear 157, but the example is not limited thereto. The transfer gear 181 may be disposed at a front end of the drive gear 157.

The transfer gear 181 may transfer a rotating force of the knock-up shaft 153 to the pickup shaft 133. The transfer gear 181 may be directly or indirectly coupled with the pickup gear 185.

It is necessary that the pickup roller 131, after rotating predetermined times to feed a paper P a piece at a time, stops for a predetermined time until the next piece of paper is fed. To this end, a tooth form may be formed at a part of a circumference of the transfer gear 181.

The transfer gear 181 may include a tooth form area 181*a* engaged with the pickup gear 185 and a cutting area 181*b* releasing engagement with the pickup gear. The transfer gear 181 may include a partial gear.

The tooth form area 181*a* of the transfer gear 181 may be rotated as being engaged with the pickup gear 185, and may rotate the pickup shaft 133 coupled to the pickup gear 185 so that the pickup roller 131 coupled to the pickup shaft 133 is rotated and picks up a paper P.

While the pickup gear 185 is engaged with the tooth form area 181*a* of the transfer gear 181, the pickup roller 131 may be rotated. While the pickup gear 185 corresponds to the cutting area 181*b* of the transfer gear 181, the pickup roller 131 may be stopped.

The cutting area 181 of the transfer gear 181 may release engagement of the transfer gear 181 and the pickup gear 185 and stop rotation of the pickup roller 131.

The pickup roller 131 may adjust a pickup period by the tooth form area 181*a* and cutting area 181*b* of the transfer gear 181. The cutting area 181*b* may be disposed at a section of a circumference of a gear 181 transferring paper P that corresponds to a time it takes to pick up a piece of paper and then picks up the next.

The cutting area 181*b* of the transfer gear 181 may be formed as much as a section corresponding to a paper interval which is a distance between papers. While the pickup gear 185 is engaged with the cutting area 181*b* of the transfer gear 181, the pickup roller 131 may be stopped, delay the paper feed and secure the paper interval. The transfer gear 181 may regulate rotation of the pickup roller 131.

The pickup roller 131 may be configured to rotate more than one rotation according to a gear ratio of the transfer gear 181 to the pickup roller 131.

The feeding apparatus 100 according to an example may include a pickup member 130 of a retard method and the pickup member 130 of the retard method may further include a feeding roller 132 and a retard roller 135 as well as the pickup roller 131. Thus, a roller may be formed to be small to minimize space constraints. The pickup roller of which a diameter is formed to be small rotates multiple times to pick up a piece of paper. To operate the pickup roller 131 for which multiple rotations are performed, a gear ratio of the transfer gear 181 to the pickup gear 185 may be formed such that the pickup roller 131 is rotated more than one rotation.

A diameter of the transfer gear 181 may be larger than that of the pickup gear 185 and thus, a rotation speed at which a rotating force is received from the knock-up shaft 153 may be increased. That is, a rotation speed of the pickup shaft 133 may be increased compared with a rotation speed of the knock-up shaft 153 by the transfer gear 181.

The pickup roller 131 may rotate at least more than one rotation to pick up a piece of paper. The transfer gear 181 and the pickup gear 185 may be formed to have a gear ratio for rotating the pickup roller 131 multiple times.

A rotation angle of the pickup gear 185 may be formed to be larger than a rotation angle of the transfer gear 181.

For example, a diameter of the transfer gear 181 may be formed to be larger than a diameter of the pickup gear 185. By the transfer gear 181, a rotation speed of the knock-up shaft 153 is increased and transferred to the pickup gear 185.

Accordingly, the pickup shaft 133 receiving a rotating force via the transfer gear 181 and the pickup gear 185 while the knock-up shaft 153 is rotated once may be rotated at least more than once.

The feeding apparatus 100 according to an example may operate a rise and fall of the knock-up plate 120 and a rotation of the pickup roller 131 via the driving force transfer member 180 coupled to one driving source, and thereby space restraints and costs can be reduced. In addition, a rise and fall of the knock-up plate 120 and a rotation of the pickup roller 131 may be interlocked with each other by the driving force transfer member 180, thereby providing a reliable paper pickup and a stable image formation.

The transfer gear 181 may be engaged with the pickup gear 185 via the intermediate gear 183 which will be described later, and thus may transfer a rotating force of the knock-up shaft 153 to the pickup gear 185 via the intermediate gear 183.

The intermediate gear 183 may be provided between the knock-up shaft 153 and the pickup shaft 133. The intermediate gear 183 may be engaged with the pickup gear 185 provided in the pickup shaft 133 and the transfer gear 181 provided in the knock-up shaft 153. The intermediate gear 183 may be formed to accelerate a rotating force of the knock-up shaft 153.

When the knock-up shaft 153 is rotated by a driving force transferred to the drive gear 157 provided in the knock-up shaft 153, the transfer gear 181 provided in the knock-up shaft 153 may be rotated. When the transfer gear 181 is rotated, the intermediate gear 183 engaged with the transfer gear 181 may be rotated. When the intermediate gear 183 is rotated, the pickup gear 185 engaged with the intermediate gear 183 may be rotated. When the pickup gear 185 is rotated, the pickup shaft 133 coupled to the pickup gear 185 may be rotated. The pickup roller 131 may be rotated together with the pickup shaft 133 and pick up a paper P.

The cam 151 may apply pressure to the knock-up plate 120 in a particular section when the knock-up shaft 153 is rotated and rotate the knock-up plate 120 in a downward direction. For example, the knock-up lever 155 which has come into contact with the cam 151 by rotation of the cam 151 may apply pressure to the knock-up plate 120 in a downward direction in a particular section. At this time, in a case in which the cam 151 is rotated further, when the knock-up lever 155 is spaced apart from the cam 151, the knock-up plate 120 may be upwardly rotated by the knock-up spring 111.

The driving force transfer member 180 may transfer a driving force transferred from a driving source to the moving member 150 to the pickup member 130, to thereby rotate the pickup roller 131 as necessary.

It is described that the driving source is a driving source exclusive for raising and dropping the knock-up plate 120, but the example is not limited thereto, and it may include a driving source for another configuration. For example, a driving source for a different use such as a driving source for driving a developer of an image forming apparatus may be used as another/dual use.

The driving force transfer member 180 may be configured such that the pickup roller 131 may be rotated in conjunction with a change of position of the knock-up plate 120 without using an additional electronic control element by the pickup member 130.

FIG. 6 is a perspective view illustrating a power transmission apparatus, according to an example.

As illustrated in FIG. 6, a feeding apparatus 100 according to an example may include a paper cassette 110, a knock-up plate 120, a pickup roller 131, a cam 151 spacing the knock-up plate 120 apart from the pickup roller 131 when a paper P is picked up and fed, and a driving force transfer member 180 transferring a rotating force of the cam 151 to the pickup roller 131.

However, the paper cassette 110, the knock-up plate 120, the pickup roller 131, and the cam are identical to the elements of the feeding apparatus 100 according to an example illustrated in FIG. 2 and thus, further description is omitted herein. Hereinafter, a description will be provided by focusing on the driving force transfer member 280 according to an example which is a distinct feature.

The driving force transfer member 280 according to an example may include a transfer gear 281 and a pickup gear 285. The transfer gear 281 may be directly coupled to the pickup gear 285. The transfer gear 181 may transfer a rotating force of the knock-up shaft 153 to the pickup shaft 133. The transfer gear 281 may include a tooth form area 281*a* engaged with the pickup gear 285 and a cutting area 281*b* releasing engagement with the pickup gear 285.

In addition, the transfer gear 281 may be disposed between the drive gear 157 and the cam 151.

The transfer gear 281 may be directly coupled to the pickup gear 285 and disposed between the drive gear 157 and the cam 151, thus minimizing the space and component specifications.

FIGS. 7A and 7B are diagrams illustrating an operation of a knock-up plate and a pickup member, according to an example.

FIG. 7A is a diagram illustrating a state in which the knock-up plate 120 is positioned at a pickup position. Referring to FIG. 7A, the knock-up plate 120 may be elevated in an upward direction by the knock-up spring 111 so that a pickup roller 131 may be in contact with a paper P.

In this case, when a knock-up shaft 153 of a moving member 150 may be rotated and a pickup interval 151*a* of the cam 151 is positioned at an opposing position to a knock-up lever 155, a force exerted to a projection 155*b* of the knock-up lever 155 by the cam 151 is released and thus, the knock-up lever 155 in contact with the knock-up plate 120 may be rotated counterclockwise. As the knock-up lever 155 is rotated counterclockwise, the knock-up plate 120 is elevated by an elastic force of the knock-up spring 111. As a result, the knock-up plate 120 is positioned at a pickup position.

While the knock-up plate 120 is positioned at a pickup position, a pickup shaft 133 of a pickup member 130 may be rotated by a rotating force of the knock-up shaft 153 received through the driving force transfer member 180. For example, while the pickup interval 151*a* of the cam 151 opposes the knock-up lever 155, a tooth form area 181*b* of a transfer gear 181 and a pickup gear 185 are engaged with each other so that a pickup shaft 133 may be rotated.

By the rotation of the pickup shaft 133, the pickup roller 131 may pick up a paper. In this case, the pickup roller 131 may be rotated multiple times by a gear ratio of the transfer gear 181 to the pickup gear 185.

FIG. 7B is a diagram illustrating a state in which the knock-up plate 120 is positioned at a release position. Referring to FIG. 7B, the knock-up plate 120 may be pressed by the moving member 150, dropped down, and spaced apart from the pickup roller 131.

In this case, when a knock-up shaft 153 of a moving member 150 may be rotated and a release interval 151*b* of the cam 151 is positioned at an opposing position to a knock-up lever 155, the cam 151 may apply pressure to the projection 155*b* of the knock-up lever 155 and thus, the knock-up lever 155 in contact with the knock-up plate 120 may be rotated clockwise. As the knock-up lever 155 is rotated clockwise, the knock-up plate 120 is pressed the knock-up lever 155 and dropped. As a result, the knock-up plate 120 is positioned at a release position.

While the knock-up plate 120 is positioned at a release position, the pickup shaft 133 of the pickup member 130 may receive a rotating force of the knock-up shaft 153 from the driving force transfer member 180. However, in this case, the engagement of the pickup gear 185 with the transfer gear 181 may be released by the cutting area 181*b* of the transfer gear 181 and the pickup shaft 133 may not be rotated. Accordingly, the pickup roller 131 may be stopped at a release position of the knock-up plate 120.

During a pickup period, the knock-up plate 120 may be driven to rise and drop by one rotation of the knock-up shaft 153, and the pickup roller 131 may be driven to rotate multiple rotations along with the pickup shaft 133 by the driving force transfer member 180.

The feeding apparatus 100 according to an example may include a driving force transfer member 180 and, even in a case in which multiple rotations of the pickup roller 131 are performed, such as a pickup member of a retard method, raise and drop the knock-up plate 120 and rotate the pickup roller 131. Accordingly, the feeding apparatus 100 can be minimized and the manufacturing cost can be reduced.

The foregoing examples are merely examples and are not to be construed as limiting the disclosure. The disclosure can be readily applied to other types of apparatuses. Also, the description of the examples of the disclosure is intended to be illustrative, and not to limit the scope of the claims, and many changes, modifications, and variations will be apparent to those skilled in the art.

What is claimed is:

1. A feeding apparatus, comprising:

a knock-up plate to be rotatably installed in a main body of an image forming apparatus and to accommodate a recording medium;

a knock-up spring to elastically apply pressure to the knock-up plate in a direction of a pickup roller of the image forming apparatus, when the knock-up plate is rotatably installed in the main body;

a knock-up shaft rotatably installed on an upper part of the knock-up plate;

a cam, fixed at one end of the knock-up shaft, to downwardly apply pressure to the knock-up plate; and a driving force transfer member to transfer a rotating force of the knock-up shaft to the pickup roller, when the knock-up plate is rotatably installed in the main body, wherein the driving force transfer member comprises:

a transfer gear supported by the knock-up shaft, and a pickup gear engaged with the transfer gear and supported at one end of a pickup shaft that supports the pickup roller.

2. The feeding apparatus as claimed in claim 1, wherein the driving force transfer member is to rotate the pickup roller more than one rotation while the knock-up shaft is rotated once.

3. The feeding apparatus as claimed in claim 1, wherein the transfer gear and the pickup gear have a gear ratio for rotating the pickup roller a plurality of times.

4. The feeding apparatus as claimed in claim 3, wherein a rotation angle of the pickup gear is larger than a rotation angle of the transfer gear.

5. The feeding apparatus as claimed in claim 1, wherein the transfer gear is to restrict rotation of the pickup gear.

6. The feeding apparatus as claimed in claim 5, wherein the transfer gear includes a partial gear which includes a tooth form area to engage with the pickup gear and a cutting area to release engagement with the pickup gear.

7. The feeding apparatus as claimed in claim 1, wherein the driving force transfer member further includes:

an intermediate gear disposed between the transfer gear and the pickup gear.

8. The feeding apparatus as claimed in claim 1, further comprising:

a solenoid to selectively rotate the knock-up shaft.

9. The feeding apparatus as claimed in claim 8, wherein the driving force transfer member is installed between the cam and the solenoid.

10. An image forming apparatus, comprising:

a main body;

a pickup roller installed in the main body;

a feeding apparatus, including:

a knock-up plate, rotatably installed in the main body, to accommodate a recording medium, a knock-up spring to elastically apply a pressure to the knock-up plate in a direction of the pickup roller, a knock-up shaft rotatably installed on an upper part of the knock-up plate, a cam, fixed at one end of the knock-up shaft, to downwardly apply a pressure to the knock-up plate, and a driving force transfer member to transfer a rotating force of the knock-up shaft to the pickup roller, wherein the driving force transfer member rotates the pickup roller more than one rotation while the knock-up shaft is rotated once;

a print engine to form an image on the recording medium fed from the feeding apparatus; and a discharge apparatus to discharge the recording medium on which the image is formed by the print engine.

11. The image forming apparatus as claimed in claim 10, wherein the driving force transfer member includes:

a transfer gear supported by the knock-up shaft, and a pickup gear engaged with the transfer gear and supported at one end of a pickup shaft that supports the pickup roller.

12. The image forming apparatus as claimed in claim 11, wherein the transfer gear and the pickup gear have a gear ratio for rotating the pickup roller a plurality of times.

13. The image forming apparatus as claimed in claim 11, wherein the transfer gear is to restrict rotation of the pickup roller.

* * * * *